US005845371A

United States Patent [19]

Chen

[11] Patent Number: 5,845,371

[45] Date of Patent: Dec. 8, 1998

[54] SECURING DEVICE FOR FOOTWEAR

[76] Inventor: Chin Chu Chen, No.11,Lane 188,Industrial Rd,Lung-Ching Hsiang, Taichung Hsien, Taiwan

[21] Appl. No.: 74,390

[22] Filed: May 8, 1998

[51] Int. Cl.[6] ..... A43C 11/14

[52] U.S. Cl. ..... 24/71 SK; 24/68 SK; 36/50.5

[58] Field of Search ..... 24/68 R, 68 A, 24/69 SK, 70 SK, 71 SK, 70 ST, 311, 629; 36/50.5

[56] References Cited

U.S. PATENT DOCUMENTS

| | | | |
|---|---|---|---|
| 4,395,801 | 8/1983 | Gabrielli | 24/71 SK X |
| 4,470,175 | 9/1984 | Chiarella | 24/71 SK X |
| 4,670,946 | 6/1987 | Olivieri | 24/71 SK |
| 5,172,454 | 12/1992 | Martignago | 24/71 SK X |
| 5,383,258 | 1/1995 | Nicoletti | 24/71 SK X |
| 5,575,045 | 11/1996 | Chu | 24/71 SK X |
| 5,669,122 | 9/1997 | Benoit | 24/71 SK |
| 5,701,639 | 12/1997 | Chen | 24/71 SK |
| 5,715,582 | 2/1998 | Zorzi | 24/71 SK |
| 5,720,084 | 2/1998 | Chen | 24/68 SK |

*Primary Examiner*—Anthony Knight
*Assistant Examiner*—Robert J. Sandy
*Attorney, Agent, or Firm*—Bacon & Thomas

[57] ABSTRACT

A securing device for footwear includes a toothed band fixedly connected a first end thereof to an item of footwear and a second end thereof inserted into a frame pivotally connected to a lever member which is pivotally connected to a base member fixedly disposed to the item of footwear. The lever member has an operation member biasedly received therein and disengagably connected to a protrusion extending from the base member so as to position the lever member. The frame has an actuating member pivotally connected thereto which is located close to the first end of the toothed band, the actuating member having a hook edge formed to an underside thereof so as to be disengagably engage the toothed band. Therefore, when pivoting the actuating member, the toothed band is loosened and can be adjusted by engaging the hook edge with the toothed band again.

2 Claims, 6 Drawing Sheets

SECURING DEVICE FOR FOOTWEAR

FIELD OF THE INVENTION

The present invention relates to a securing device for footwear, particularly used for sports footwear such as boots for skiing, hockey or cycling. The device includes an actuating member disposed to a central top of the boot so as to prevent an unintentional impact to the actuating member.

BACKGROUND OF THE INVENTION

A conventional securing device for footwear is disclosed in U.S. Pat. No. 4,670,946 to Olivieri, entitled as "Binding Device With Articulated Components Particularly For Use With Sport Implements". In the invention of Olivieri involves a lever extending transversely corresponding to the boot on which the securing device is disposed, the lever is located on a lateral side of the boot so that when the securing device is to be unfastened, the wearer pulls the lever arm upwardly by his/her hand so as to loosen a tooth band engaged with a wedge disposed on the other lateral side of the boot. When adjusting the tooth band, the lever is remained in a close condition and the wedge is pivoted to disengage from the toothed band so that the toothed band can be pulled or loosed slightly and the wedge is again engaged with one of the teeth on the toothed band. Although this is a convenient design for the wearers to operate the wedge, an accidental impact to the wedge could happen either by the other boot of the wearer or by other object such as the hockey rackets. Once the wedge is pushed or pivoted, a dangerous result could happen.

In order to improve this, U.S. Pat. No. 5,720,084 own by Applicant has provided an improved securing device which amends the structure of the lever so that the possibility of pulling the lever unintentionally can be effectively reduced. Nevertheless, the wedge is still positioned on lateral side of the boots so that there exists a potential risk.

Moreover, one of two ends of the toothed band is connected to the boot by rivets so that the boot could be torn at the position where the rivets penetrate after a long-term utilization.

The present invention intends to provide a securing device for footwear which has an actuating member disposed to a central top of the sport boot so as to mitigate the problems mentioned above.

SUMMARY OF THE INVENTION

In accordance with one aspect of the present invention, there is provided a securing device comprising a toothed band having a first end with an insertion part formed thereto so as to securely engaged with an item of footwear, and a second end extending through a frame. A base member is fixedly connected to the item of footwear and has two lugs extending from two opposite sides of a first end thereof and a protrusion extending upwardly from a second end thereof.

A lever member has two arms extending from a first end thereof so as to be pivotally connected to the two lugs, and a second end having a recess defined therein. An aperture is defined in an underside of the second end of the lever member so that the protrusion of the base member extends therein. An operation member is biasedly received in the recess and has a stop disposed thereto so as to be disengagably engaged to the protrusion. The frame has a first end thereof with two side walls extending from two opposite sides thereof, and a second end pivotally connected between the two arms and located between the two lugs and the operation member.

An actuating member is biasedly and pivotally connected between the two side walls of the frame and has a hook edge formed to an underside of a first end thereof so as to be disengagably engaged to the toothed band.

Other objects, advantages and features of the present invention will become apparent after a careful reading of the detailed description when taken in conjunction with the accompanying drawings.

DETAILED DESCRIPTION OF THE PREFERRED EMBODIMENT

Figure 1:
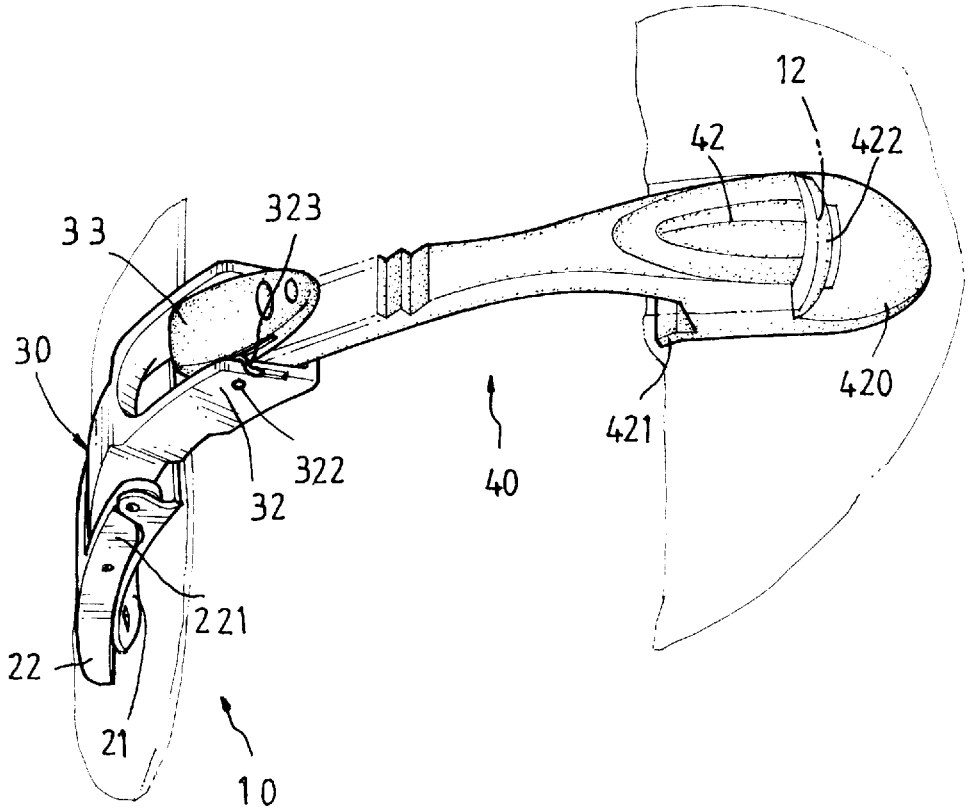
FIG. 1 is a perspective view of a securing device in accordance with the present invention.
Figure 2:
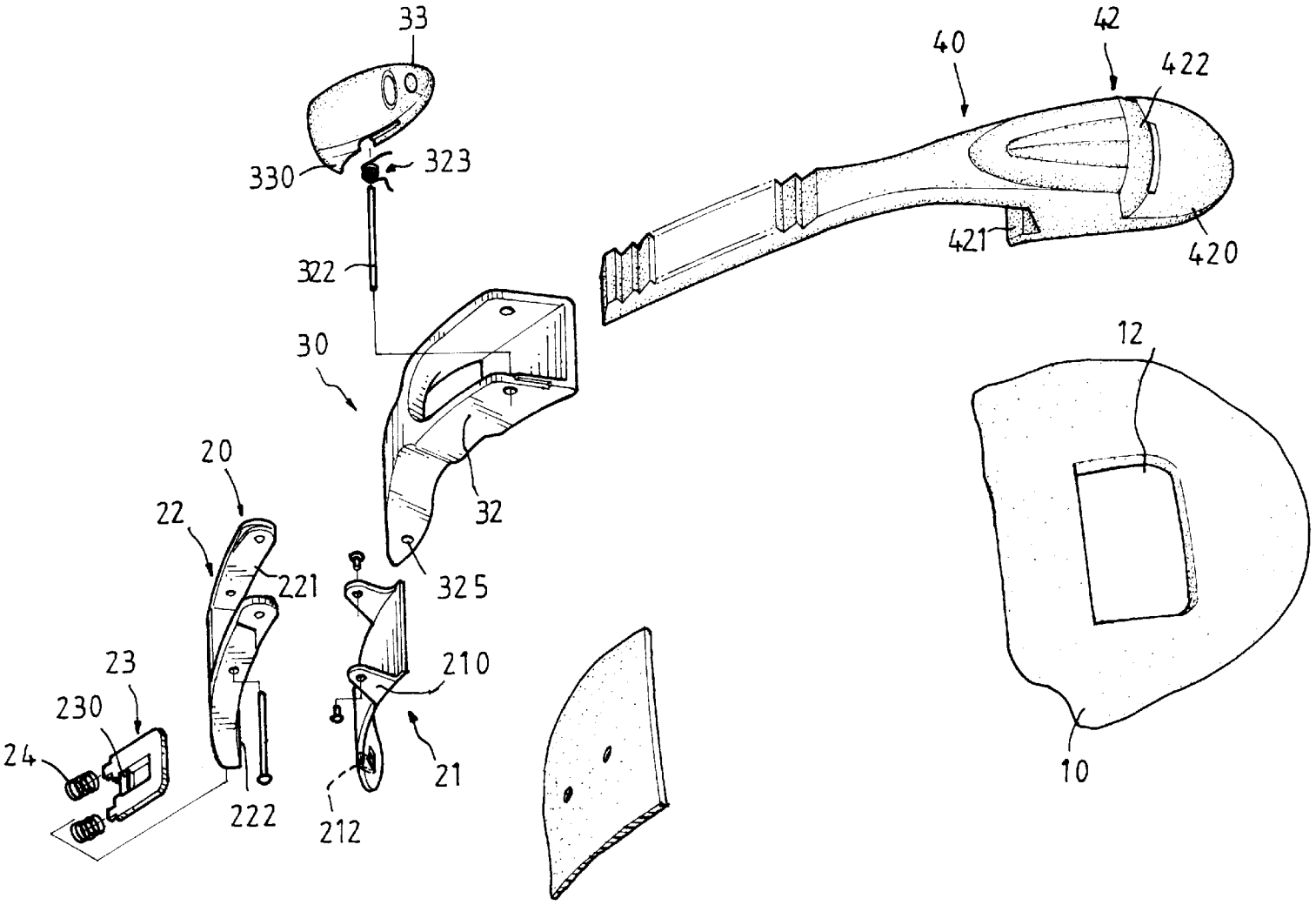
FIG. 2 is an exploded view of the securing device in accordance with the present invention.
Figure 3:
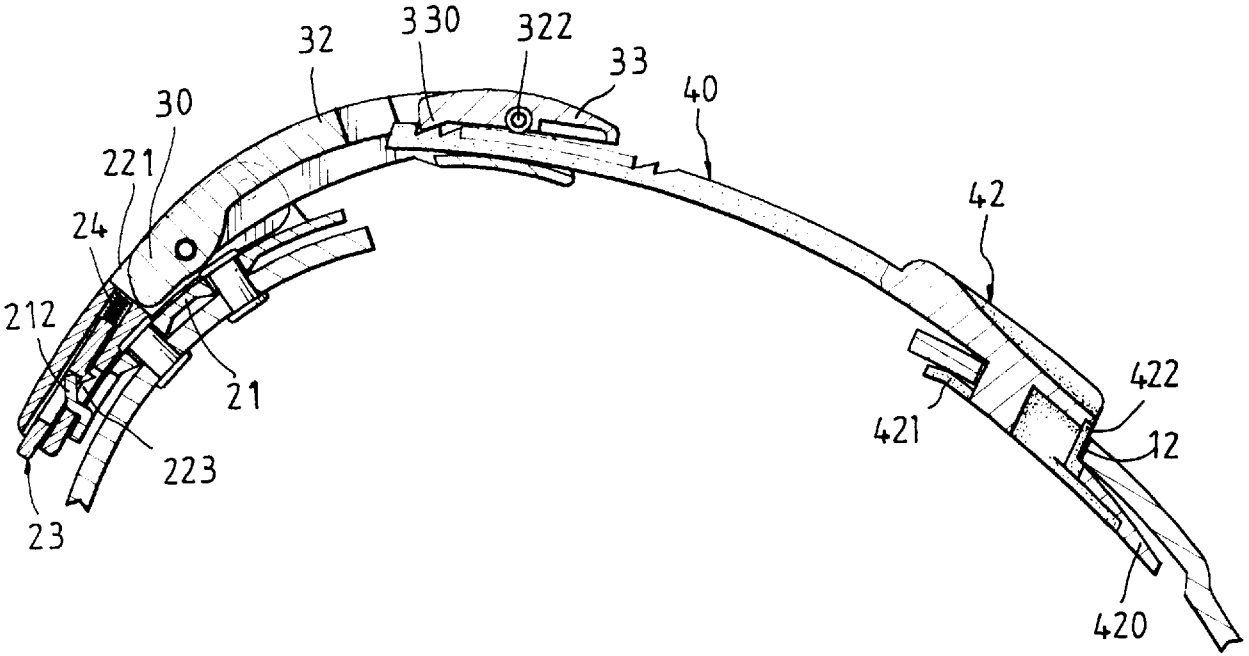
FIG. 3 is a side elevational view, partly in section, of the securing device when the toothed is securely positioned at a first position.

Referring to FIGS. 1 through 3, a securing device for footwear includes a toothed band 40 having a first end with an insertion part 42 formed thereto which is suitable to be securely engaged with an item of footwear, and a second end. An item 10 of footwear has a hole 12 defined in a lateral side thereof and the insertion part 42 has tongue 420 formed to a distal end thereof with a shoulder portion 422 formed on an upper surface of the tongue 420 and a groove 421 defined laterally in an underside thereof. Therefore, the tongue 420 is inserted into the hole 12 with the shoulder portion 422 being engaged with a side of a periphery defining the hole 12 and an opposite side of the periphery defining the hole 12 being received in the groove 421 so as to securely connect the first end of the toothed band 40 to the item of footwear.

A base member 21 is fixedly connected to the item of footwear opposite to the hole 12 and has two lugs 210 extending from two opposite sides of a first end thereof and a protrusion 212 extending upwardly from a second end thereof . A lever member 22 has two arms 221 extending from a first end thereof so as to be pivotally connected to the two lugs 210, and a second end in which a recess 222 is defined. An operation member 23 is biasedly received in the recess 222 by two springs 24 and has a stop 230 disposed thereto. An aperture 223 is defined in an underside of the second end of the lever member 30 so as to receive the protrusion 212 of the base member 21 therein and the the stop 230 is disengagably engaged to the protrusion 212. Therefore, when the stop 230 is engaged with the protrusion 212, the lever arm 22 is limited to be pulled upwardly.

Figure 4:
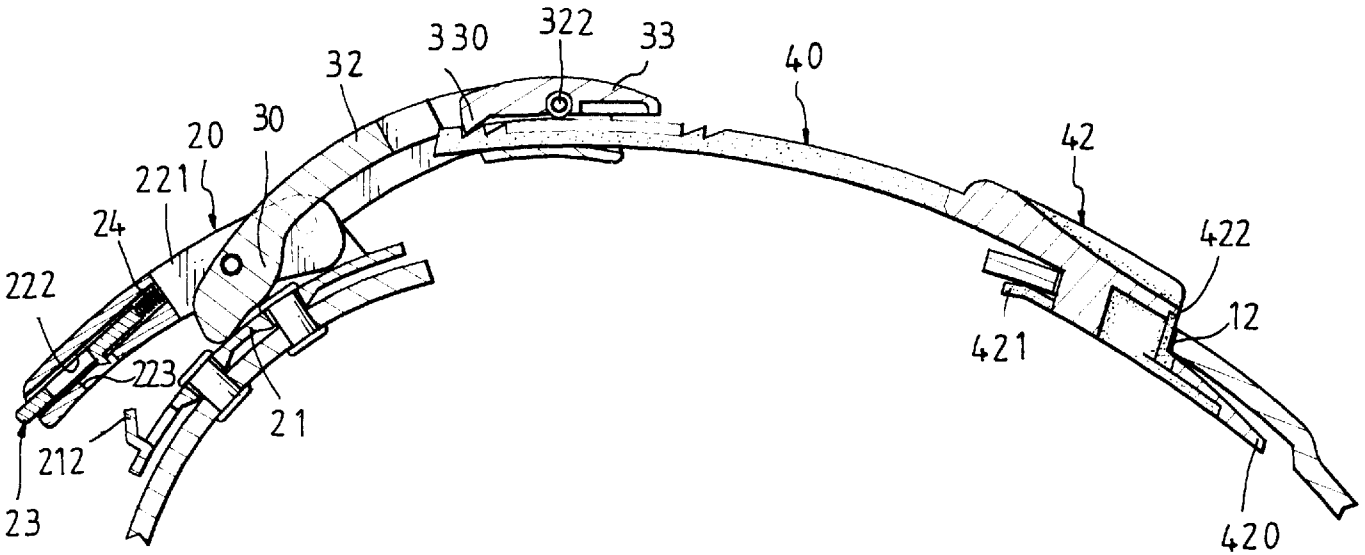
FIG. 4 is a side elevational view, partly in section, of the securing device when the toothed is loosened by pushing the actuating member.

A frame 30 has a first end thereof with two side walls 32 extending from two opposite sides thereof, and a second end pivotally connected between the two arms 221 and located between the two lugs 210 and the operation member 23. An actuating member 33 is biasedly and pivotally connected between the two side walls 32 of the frame 30 by a pin 322 and a torsion spring 323. The actuating member 33 has a hook edge 330 formed to an underside of a first end thereof so as to be disengagably engaged to the toothed band 40 at a first position as shown in FIG. 3. Therefore, when pushing the operation member 23 to disengage the stop 230 from the protrusion 212 and pivoting the lever member 22 upwardly about the two lugs 210, as shown in FIG. 4, the frame 32 is pulled upwardly and the toothed band 40 is loosened toward the first end of the toothed band 40.

Figure 5:
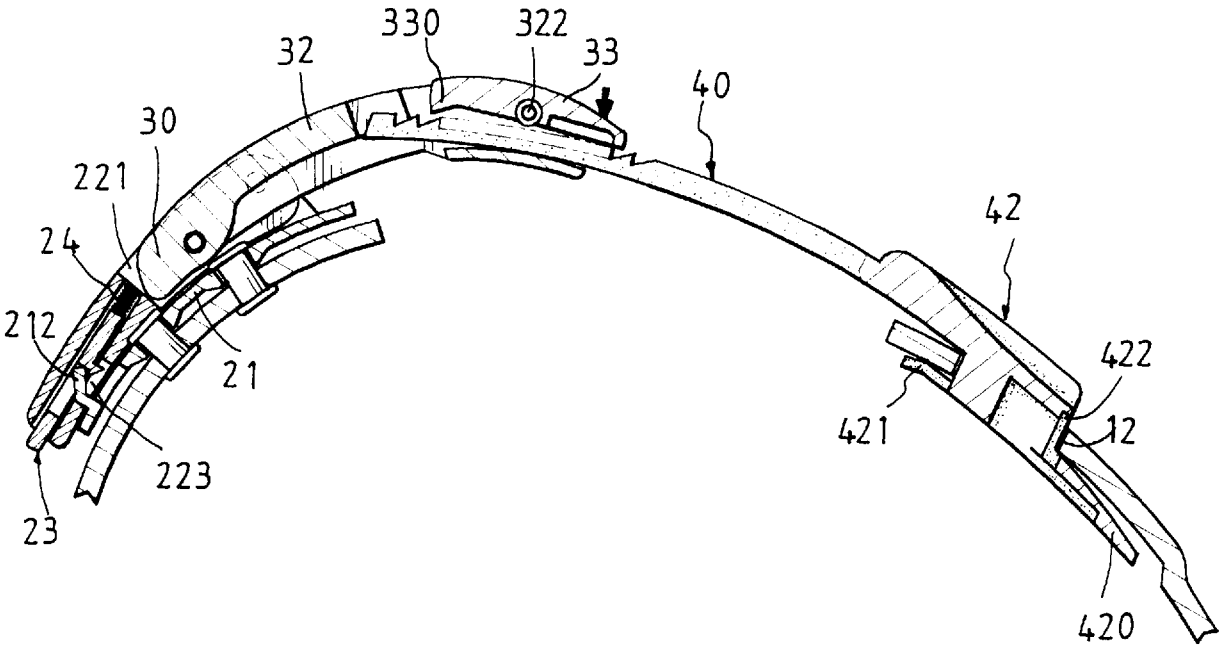
FIG. 5 is a side elevational view, partly in section, of the securing device when the actuating member is pushed to disengage from the toothed band.
Figure 6:
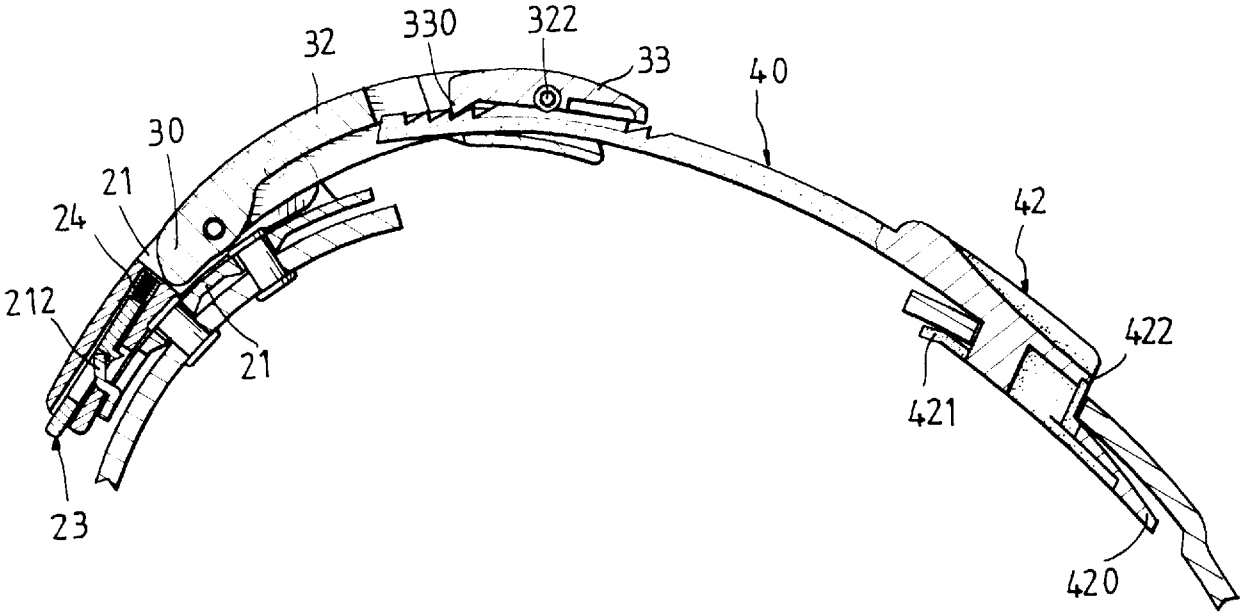
FIG. 6 is a side elevational view, partly in section, of the securing device when the toothed is again securely positioned at a second position by engaging the actuating member with the toothed band.

Referring to FIG. 5, the toothed band 40 can be also adjusted by pushing the actuating member 33 downwardly to disengage the hook edge 330 from the toothed band 40 so that the toothed band 40 is loosened from the first position and then pulled toward the frame 32. The actuating member 33 is then released and engages with the toothed band 40 at a second position again as shown in FIG. 6.

Accordingly, the actuating member 33 is disposed in a central part of the item of footwear so as to effectively prevent an unintentional impact to the actuating member 33. Furthermore, the first end of the toothed band 40 is securely engaged with the periphery defining the hole 12 without using rivets so that the item of footwear cannot not be torn as described in above.

Although the invention has been explained in relation to its preferred embodiment, it is to be understood that many other possible modifications and variations can be made without departing from the scope and spirit of the present invention.

What is claimed is:

1. A securing device comprising:

a toothed band having a first end with an insertion part formed thereto which is suitable to be securely engaged with an item of footwear, and a second end;

a base member suitable to be fixedly connected to said item of footwear and having two lugs extending from two opposite sides of a first end thereof and a protrusion extending upwardly from a second end thereof;

a lever member having two arms extending from a first end thereof so as to be pivotally connected to said two lugs, and a second end in which a recess is defined, an aperture being defined in an underside of said second end of said lever member so as to receive said protrusion of said base member therein;

an operation member biasedly received in said recess and having a stop disposed thereto so as to be disengagably engaged to said protrusion;

a frame having a first end thereof with two side walls extending from two opposite sides thereof, and a second end pivotally connected between said two arms and located between said two lugs and said operation member; and an actuating member biasedly and pivotally connected between said two side walls of said frame and having a hook edge formed to an underside of a first end thereof so as to be disengagably engaged to said toothed band.

2. The securing device as claimed in claim 1, wherein said insertion part includes a tongue formed to a distal end thereof with a shoulder portion formed on an upper surface of said tongue, and a groove defined laterally in an underside of said insertion part so that said tongue and said groove are suitable to be engaged with a periphery defining a hole in said boot.

* * * * *